United States Patent [19]

Looger

[11] 3,960,054

[45] June 1, 1976

[54] ANTI-TANK ROCKET LAUNCHER TELESCOPING TUBE LOCKING DEVICE

[75] Inventor: Lonnie L. Looger, Madison, Ala.

[73] Assignee: The United States of America as represented by the Secretary of the Army, Washington, D.C.

[22] Filed: Dec. 23, 1974

[21] Appl. No.: 535,231

[52] U.S. Cl. ..... 89/1.816; 403/108

[51] Int. Cl.[2] ..... F41F 3/04

[58] Field of Search ..... 89/1.7, 1.8, 1.813, 89/1.816, 1.817, 1.819; 403/108, 109, 329, 106, 13, 14

[56] References Cited

UNITED STATES PATENTS

| | | | |
|---|---|---|---|
| 2,047,485 | 7/1936 | McBrady | 403/108 X |
| 2,477,167 | 7/1949 | Bliss | 403/108 X |
| 3,182,553 | 5/1965 | Choate et al. | 89/1.817 |
| 3,208,347 | 9/1965 | Choate | 89/1.816 X |
| 3,256,777 | 6/1966 | Choate et al. | 89/1.817 X |
| 3,371,578 | 3/1968 | Choate et al. | 89/1.816 X |

*Primary Examiner*—David H. Brown

*Attorney, Agent, or Firm*—Nathan Edelberg; Robert P. Gibson; Harold W. Hilton

[57] ABSTRACT

A man transportable rocket launcher including a pair of telescoping sections, launch tubes, which are telescoped to a short length for transporting and extended to a longer length for launching of the rocket. A locking device is provided for maintaining the launch tubes in the extended condition for rocket launching.

4 Claims, 3 Drawing Figures

ANTI-TANK ROCKET LAUNCHER TELESCOPING TUBE LOCKING DEVICE

BACKGROUND OF THE INVENTION

This invention relates to the field of rocket launchers. Recent rocketry development has produced several smaller caliber rockets that are extremely useful against tanks and other vehicles. Since the launcher must be man-transportable, weight is a prime consideration in such launcher design.

The problems of retaining telescoping tubes in the extended condition has a multitude of approaches but only a few result in a design of simplicity, ease of operation and a very minimum of weight. The locking device must hold the tubes in the extended position, but more importantly the tube must be prevented from rotating along the center line. This rotation would cause the launcher with a front sight on one tube and a rear sight on the other tube to be very inaccurate.

SUMMARY OF THE INVENTION

The launcher of the present invention includes a pair of telescoping sections having a spline lock means for maintaining the tubes in extended position for rocket launching. The aft, or outer tube, is provided with a reinforcing ring at the aft end and a retainer ring at the forward end. The inner tube is provided with a filler ring at the aft end thereof, a reinforcing ring at the forward end thereof and a second filler ring intermediate the forward and aft rings. The filler rings are slidable in the outer tube and serve as spacers so that close tolerances can be maintained between the inner and outer tubes. A locking member is secured to the inner tube and is carried inside the outer tube when the tubes are in the non-extended position. The locking member slides in a slot in the retainer ring on the outer tube. The locking member is provided with dove-tail that mates with a dove-tail of the retainer ring to assure that the tubes remain aligned with each other. The locking member includes a spring portion that raises for engagement with the outer surface of the retainer ring to maintain the launcher in extended position. A release member secured to the retainer ring is disposed for engagement with the raised portion of the locking member for depressing the locking member for release of the sections from locked engagement.

DESCRIPTION OF THE PREFERRED EMBODIMENT

Figure 1:
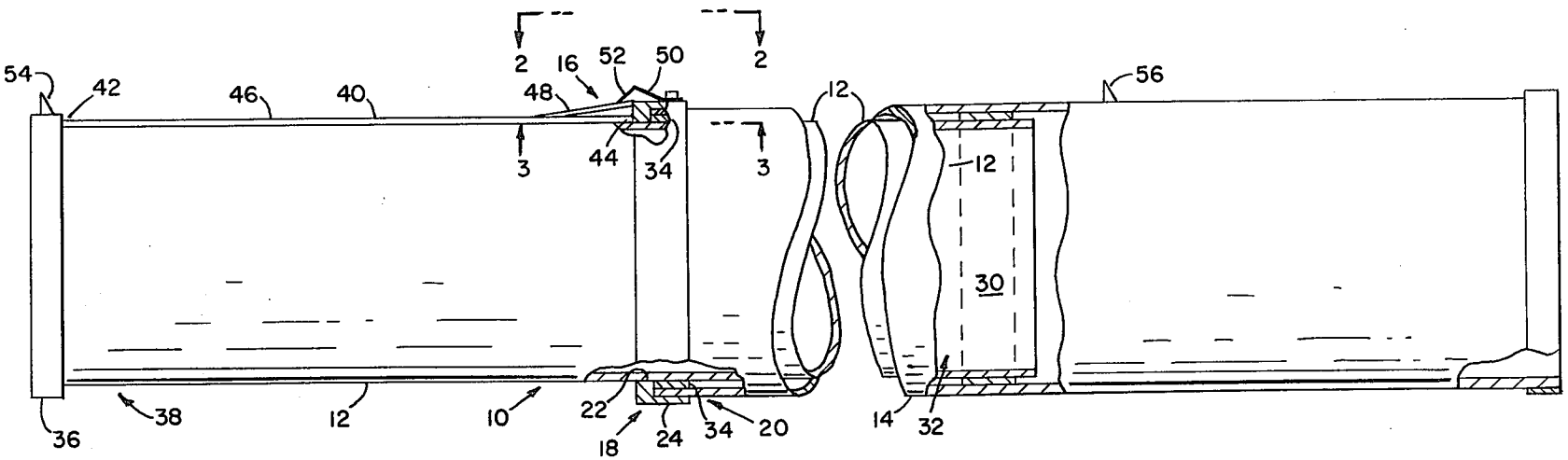
FIG. 1 is an elevation view of the launcher assembly including the spline lock for holding the tubes in extended position.

As seen in FIG. 1, a rocket launcher 10 includes a forward tube section 12 and an aft tube section 14. A spline lock assembly 16 is carried by the tube sections for cooperation therebetween to maintain the tubes in extended position as shown.

Figure 3:
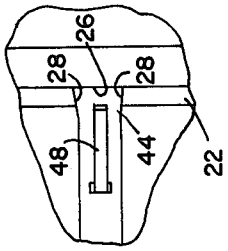
FIG. 3 is an enlarged partial view along line 3—3 of FIG. 1 showing the engagement of the locking member with the retainer ring.

As shown in FIG. 1, the aft tube section 14 includes a retainer ring 18 secured to the forward end 20 of aft tube section 14. The retainer ring 18 is bonded by an epoxy adhesive to the tube. The retainer ring 18 is provided with an inwardly extending annular flange 22 and a cylindrical portion 24. As seen in FIG. 3, a groove 26 is provided in the annular flange and includes dove-tailed surfaces 28.

Inner tube section 12 includes a first filler ring 30 secured to the aft end 32 thereof, a second filler ring 34 secured intermediate the ends of the tube section, and a reinforcing ring 36 secured to the forward end 38 of inner tube section 12. The rings are secured to the tube section by an epoxy adhesive. Ring sections 30 and 34 are affixed to the inner telescoping tube and are provided with an outside diameter to permit required sliding tolerances between the inner and outer tubes while also maintaining concentricity limits between the telescoping tubes.

Figure 2:
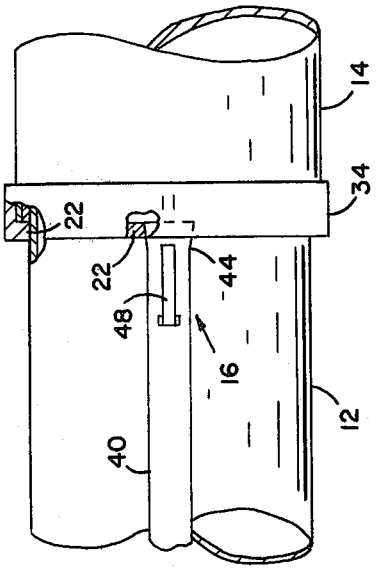
FIG. 2 is a plan view, partially in section, along line 2—2 of FIG. 1 showing the spline lock in engagement with the retainer ring on the outer tube to maintain the tubes in extended position.

Spline lock assembly 16 includes a locking member 40 which is secured to the inner tube section by an epoxy adhesive (FIGS. 1 and 2) having a forward end 42 (FIG. 3) which abuts against forward reinforcing ring 36 and an aft dove-tailed portion 44 (FIGS. 1 and 3) which abuts against filler ring 34. The upper surface 46 of member 40 is flush with the outer annular surfaces of filler rings 34 and 30. Member 40 includes a cut-out, raised spring portion 48 adjacent dove-tailed portion 44. A spring member 50 is secured to retainer ring 18 and is provided with a downwardly extending tip 52 for engagement with spring portion 48 of the locking member.

To assemble the tubes, the smaller diameter tube 12 is inserted into tube 14 from the rear thereof. The forward reinforcing ring 36 is installed after the final assembly of the two tubular sections.

In operation, the tubes are extended to the position shown in FIG. 1 so that the spring portion of the locking member is in engagement with the outer surface of the retaining ring 18 and the dove-tail portion 44 of the locking member is confined in dove-tail surfaces 28 of the retaining ring to prevent. In this position the tubes are retained in their extended position and are locked against rotational movement misalignment of forward sight 54 and rear sight 56. Filler ring 34 is disposed for abutting relation with flange 22 of the retaining ring to prevent separation of the tubes.

To release the tubes from the locked engagement, spring 50 is depressed so that tip 52 thereof engages spring portion 48 of the locking member for downward movement thereof for the disengagement.

I claim:

1. A lightweight man-transportable rocket launcher comprising:

a. first and second tubular sections connected to telescope between a shortened, inoperative position and an extended operative position, said second tubular section being mounted in said first tubular section;

b. a first sight carried on said first tubular section, and, a second sight carried on said second tubular section; and, c. locking assembly means carried by said sections for securing said sections in said extended position and for preventing relative rotation therebetween whereby said sights will be maintained in alignment; said locking assembly means including a locking member carried on said second tubular section, said locking member having a dove-tail portion at one end thereof, and, a retaining ring secured to the aft end of said first tubular section, said retaining ring having a dove-tail groove on the inner surface thereof to receive said dove-tail portion of said locking member.

2. A rocket launcher as set forth in claim 1 wherein said locking member is provided with a spring portion adjacent said dove-tail portion which raises for engagement with said retaining ring for retention of said tubular sections in said extended position.

3. A rocket launcher as set forth in claim 2 wherein said second tubular member is provided with a ring member secured around the outer surface thereof, and said retaining ring including an inwardly extending annular flange against which said ring member abuts responsive to extension of said tubular sections to prevent separation of said members.

4. A rocket launcher as set forth in claim 3 including a spring member secured to said retaining ring, said spring member having a downwardly extending tip for engagement with said raised spring portion of said locking member for downwardly movement thereof for release of said tubular sections from the locked engagement.

* * * * *